US008338766B2

(12) United States Patent
Gaylor et al.

(10) Patent No.: US 8,338,766 B2
(45) Date of Patent: Dec. 25, 2012

(54) MICROWAVEABLE PACKAGE FOR FOOD PRODUCTS

(75) Inventors: Ian Michael Daines Gaylor, Cambourne (GB); Charles Daniel Bonner, Naperville, IL (US); Annie Louise Charlotte Broadhurst, Plymouth (GB)

(73) Assignee: The Hillshire Brands Company, Downers Grove, IL (US)

( * ) Notice: Subject to any disclaimer, the term of this patent is extended or adjusted under 35 U.S.C. 154(b) by 1107 days.

(21) Appl. No.: 12/197,805

(22) Filed: Aug. 25, 2008

(65) Prior Publication Data

US 2009/0061053 A1 Mar. 5, 2009

Related U.S. Application Data

(60) Provisional application No. 60/966,965, filed on Aug. 31, 2007.

(51) Int. Cl.
*H05B 6/80* (2006.01)

(52) U.S. Cl. ..... 219/730; 219/728; 426/107

(58) Field of Classification Search ..... 219/730, 219/725, 727, 731–733, 736, 759; 426/107, 426/113, 234; 206/805, 497, 524, 484; 428/163, 428/328, 105

See application file for complete search history.

(56) References Cited

U.S. PATENT DOCUMENTS

| | | | | |
|---|---|---|---|---|
| 4,267,420 | A | | 5/1981 | Brastad |
| 4,689,458 | A | | 8/1987 | Levendusky et al. |
| 4,761,290 | A | | 8/1988 | Meraj et al. |
| 4,833,007 | A | * | 5/1989 | Huang ..... 426/243 |
| 4,841,112 | A | | 6/1989 | Peleg |
| 4,870,233 | A | | 9/1989 | McDonald et al. |
| 4,876,423 | A | | 10/1989 | Tighe et al. |
| 4,890,439 | A | | 1/1990 | Smart |
| 4,892,782 | A | * | 1/1990 | Fisher et al. ..... 442/76 |
| 4,894,247 | A | | 1/1990 | Fong |
| 4,904,836 | A | | 2/1990 | Turpin et al. |
| 4,911,938 | A | | 3/1990 | Fisher et al. |
| 4,917,748 | A | | 4/1990 | Harrison |
| 4,927,991 | A | | 5/1990 | Wendt et al. |
| 4,970,358 | A | | 11/1990 | Brandberg et al. |
| 5,034,234 | A | | 7/1991 | Andreas et al. |
| 5,038,009 | A | * | 8/1991 | Babbitt ..... 219/730 |
| 5,039,833 | A | | 8/1991 | Woods |
| 5,096,723 | A | | 3/1992 | Turpin |

(Continued)

FOREIGN PATENT DOCUMENTS

DE 2842310 A * 4/1979

(Continued)

OTHER PUBLICATIONS

Schiffman, Microwave Technology A Half-Centruy of Progress, printed from http://www.vpico.com/articlemanager/printerfriendly.aspx?article=78061 on Jul. 2, 2007, 10 pages.

(Continued)

*Primary Examiner* — Quang Van
(74) *Attorney, Agent, or Firm* — Foley & Lardner LLP

(57) ABSTRACT

A susceptor includes a flexible substrate and a metallic material provided on at least one surface of the substrate. A first plurality of ventilation apertures are formed in the substrate and the metallic material, and the first plurality of ventilation apertures are configured to permit a fluid to pass through the substrate and the metallic material.

10 Claims, 12 Drawing Sheets

U.S. PATENT DOCUMENTS 5,104,669 A 4/1992 Wolke et al.
5,117,078 A 5/1992 Beckett
5,124,519 A 6/1992 Roy et al.
5,132,144 A 7/1992 Parks
5,177,332 A 1/1993 Fong
5,180,894 A 1/1993 Quick et al.
5,220,140 A 6/1993 Ball et al.
5,247,149 A 9/1993 Peleg
5,260,537 A 11/1993 Beckett
5,294,763 A 3/1994 Chamberlain et al.
5,308,945 A 5/1994 VanHandel et al.
5,310,977 A 5/1994 Stenkamp et al.
5,317,118 A 5/1994 Brandberg et al.
5,322,984 A 6/1994 Habeger, Jr. et al.
5,334,820 A 8/1994 Risch et al.
5,338,921 A 8/1994 Maheux et al.
5,343,024 A 8/1994 Prosise et al.
5,391,864 A 2/1995 Bodor et al.
5,393,542 A 2/1995 Stradal et al.
5,405,663 A 4/1995 Archibald et al.
5,410,135 A 4/1995 Pollart et al.
5,416,305 A 5/1995 Tambellini
5,458,898 A 10/1995 Kamper et al.
5,530,231 A 6/1996 Walters et al.
5,770,840 A 6/1998 Lorence
5,858,487 A 1/1999 Boehler et al.
5,888,609 A * 3/1999 Karttunen et al. ..... 428/107
6,048,558 A 4/2000 Feldmeier et al.
6,054,698 A 4/2000 Mast
6,083,552 A 7/2000 Kershman et al.
6,168,812 B1 1/2001 Paulucci
6,251,451 B1 6/2001 Zeng
6,303,913 B1 10/2001 Bono et al.
6,303,914 B1 10/2001 Bono et al.
6,359,272 B1 3/2002 Sadek et al.
6,414,288 B1 7/2002 Bono et al.
6,455,827 B2 * 9/2002 Zeng ..... 219/730
6,476,368 B2 11/2002 Aronsson et al.
6,717,121 B2 4/2004 Zeng et al.
6,781,101 B1 8/2004 Hoese et al.
6,818,873 B2 11/2004 Savage et al.
6,866,863 B2 3/2005 Ribi
6,884,446 B1 4/2005 Underwood et al.
6,919,547 B2 7/2005 Tsontzidis et al.
6,986,605 B1 1/2006 Allen et al.
7,015,442 B2 3/2006 Tucker, Jr. et al.
7,019,271 B2 3/2006 Wnek et al.
7,038,182 B2 5/2006 Young et al.
7,323,669 B2 1/2008 Robinson et al.
2001/0032843 A1 10/2001 Aronsson et al.
2002/0007912 A1 1/2002 Kamarehi et al.
2002/0129296 A1 9/2002 Kwiat et al.
2003/0049353 A1 3/2003 Lauen et al.
2003/0071036 A1 4/2003 Savage et al.
2003/0085224 A1 5/2003 Tsontzidis et al.
2004/0023000 A1 * 2/2004 Young et al. ..... 428/138
2004/0062839 A1 4/2004 Pedersen
2004/0234653 A1 11/2004 Cogley et al.
2004/0238534 A1 12/2004 Mast
2005/0173425 A1 8/2005 Wnek et al.
2005/0204616 A1 * 9/2005 Hinsperger ..... 47/9
2005/0230383 A1 10/2005 Romeo et al.
2005/0274590 A1 12/2005 Kwiat
2006/0010182 A1 1/2006 Altepeter et al.
2006/0049190 A1 * 3/2006 Middleton et al. ..... 219/730
2006/0080678 A1 4/2006 Bailey et al.
2006/0096978 A1 5/2006 Lafferty et al.
2006/0108359 A1 5/2006 Brough et al.
2006/0130030 A1 6/2006 Kwiat et al.
2006/0151490 A1 7/2006 Dodge et al.
2006/0157480 A1 7/2006 Lafferty
2006/0177556 A1 8/2006 Howery
2006/0178983 A1 8/2006 Nice et al.
2006/0289517 A1 12/2006 Lorbach
2006/0289518 A1 12/2006 Sharp
2006/0289519 A1 12/2006 Sharp
2006/0289522 A1 12/2006 Middleton et al.
2007/0039951 A1 2/2007 Cole
2007/0215611 A1 9/2007 O'Hagan et al.
2008/0063758 A1 3/2008 Kwiat et al.
2008/0063759 A1 3/2008 Raymond et al.
2008/0063760 A1 3/2008 Raymond et al.
2008/0075807 A1 3/2008 Baldwin et al.
2008/0085123 A1 4/2008 VanDevender et al.
2008/0099473 A1 5/2008 Carmichael et al.

FOREIGN PATENT DOCUMENTS

EP 1900650 3/2008
JP 04234476 A * 8/1992
JP 2001 019062 1/2001
WO WO 0123275 4/2001
WO WO 02/00920 1/2002
WO WO 2008/007234 1/2008
WO WO 2008/008804 1/2008

OTHER PUBLICATIONS

James River and A.D. Tech Sign Microwave Packaging Patent Licensing Agreements, James River Corporation, printed on Mar. 24, 2007, 2 pages.

International Search Report and Written Opinion for International Application No. PCT/US2008/074150; date of mailing Mar. 3, 2009; 15 pages.

* cited by examiner

MICROWAVEABLE PACKAGE FOR FOOD PRODUCTS

CROSS-REFERENCE TO RELATED PATENT APPLICATIONS

This application claims priority from U.S. Provisional Application No. 60/966,965, filed Aug. 31, 2007, which is hereby incorporated herein by reference in its entirety.

BACKGROUND

The present disclosure relates to a microwaveable package for food products, and more specifically, to a microwaveable package for bread and related baked products that utilizes one or more susceptors to improve the appearance and quality of the baked product.

There are many challenges associated with conventional microwaveable food products and microwaveable packages for such food products.

Accordingly, it would be advantageous to provide an improved microwaveable package that overcomes the disadvantages of the prior art.

SUMMARY OF THE INVENTION

One embodiment relates to a susceptor comprising a flexible substrate and a metallic material provided on at least one surface of the substrate, wherein a first plurality of ventilation apertures are formed in the substrate and the metallic material, and the first plurality of ventilation apertures are configured to permit a fluid to pass through the substrate and the metallic material.

Another embodiment relates to a microwaveable product comprising a support member having at least one recess, a first susceptor coupled to the recess and having a plurality of ventilation apertures, a dough-based food product positioned within the recess and adjacent the susceptor and configured to be at least partially proofed after being positioned within the recess and adjacent the susceptor, and a top portion coupled to the support member to enclose the food product within the recess.

Another embodiment relates to a microwaveable product comprising a package having a generally tubular shape with a longitudinal axis, a susceptor provided within the package, and a food product within the susceptor and fully proofed to substantially conform to the tubular shape of the package, wherein the package is configured to permit the food product to expand with respect to the longitudinal axis of the package during baking.

Another embodiment relates to a package for microwave baking or browning a dough-based food product, the packaging comprising an outer package, a support member having a plurality of apertures and provided within the outer package, and at least one susceptor coupled to the support member, wherein the support member includes at least one spacer configured to provide a clearance to permit steam to vent from the food product during baking.

The present disclosure further relates to various features and combinations of features shown and described in the disclosed embodiments. Other ways in which the objects and features of the disclosed embodiments are accomplished will be described in the following specification or will become apparent to those skilled in the art after they have read this specification. Such other ways are deemed to fall within the scope of the subject matter of this application if they fall within the scope of the claims which follow.

DETAILED DESCRIPTION OF EXEMPLARY EMBODIMENTS

In some embodiments, a package is provided that may include one or more susceptors that convert microwave energy into heat that is in turn transferred to a food product to provide crisping, browning, etc. of a surface of the food product.

Some food products may be provided pre-baked and simply reheated and crispened in a microwave oven, therefore creating less steam than raw dough, which typically has a higher water content. For this reason, these pre-baked products require less ventilation to achieve satisfactory results and often rely on ventilation through a susceptor that is not in intimate contact with the food product surface. Ventilation of the steam produced during heating therefore relies on the steam migrating over the product surface, potentially across significant distances.

Conventional packages that utilize susceptor technology have several disadvantages. For example, conventional packages may not provide sufficient ventilation to permit steam produced by the food product during baking to escape. This captured steam may reduce the effectiveness of the susceptors by permitting moisture to be reintroduced into the food, thereby resulting in undesirable cooling of the food product. Furthermore, conventional packages often do not provide intimate contact between the susceptor material and the surface of the food product, resulting in reduced heat transfer between the susceptor and the food product. Accordingly, various embodiments disclosed herein are intended to overcome these and other disadvantages of conventional packages.

Figure 1:
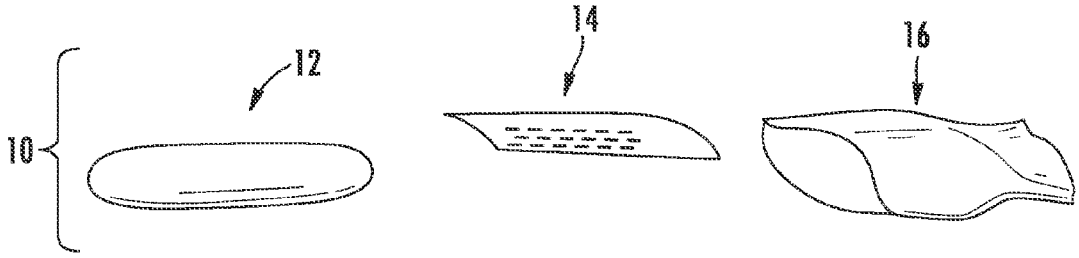
FIG. 1 is an exploded perspective view of a product according to an exemplary embodiment.

Referring now to FIG. 1, a microwaveable product 10 (e.g., a product, a retail product, etc.) is shown, and includes a package 16 (e.g., a bag, container, a sealable package, etc.), a food product 12, and a susceptor portion or susceptor 14 that may be used to provide a browned, crusted, crisped, etc. surface over at least a portion 18 (see FIG. 2) of a surface of food product 12 once baked. According to one embodiment, susceptor 14 may include a conductive or metallic (e.g., aluminum, etc.) layer of material and may be positioned within package 16 such that the susceptor 14 maintains intimate contact with food product 12 over substantially the entire area of susceptor 14.

As susceptor 14 encounters microwave energy, a portion of the energy may be reflected, a portion of the energy may be absorbed, and a portion of the energy may be transmitted. Energy that is reflected by susceptor 14 is reflected, e.g., back into the cavity of a microwave oven. Energy that is absorbed by susceptor 14 is converted into heat within the metallic layer (e.g., as a result of the eddy currents flowing within a thin sputtered metallic (e.g., aluminum) layer, which may be produced via, e.g., vacuum vaporization, evaporative deposition, sputtering deposition, electron beam sputtering, electrolyte deposition, rotary printing, etc.) of susceptor 14 and is transferred to surface 18 of food product 12 and facilitates crisping and browning of food product 12. Energy that is transmitted by susceptor 14 may pass to the body of food product 12 as microwave energy and serve to heat food product 12.

According to the various exemplary embodiments described below, package 16, food product 12, and susceptor 14 may be configured, combined, and modified in a variety of ways to suit particular applications. It should be understood that the various exemplary embodiments illustrated herein may be combined in any of a number of ways, and the present disclosure is intended to be applicable to all such combinations and embodiments.

Figure 3:
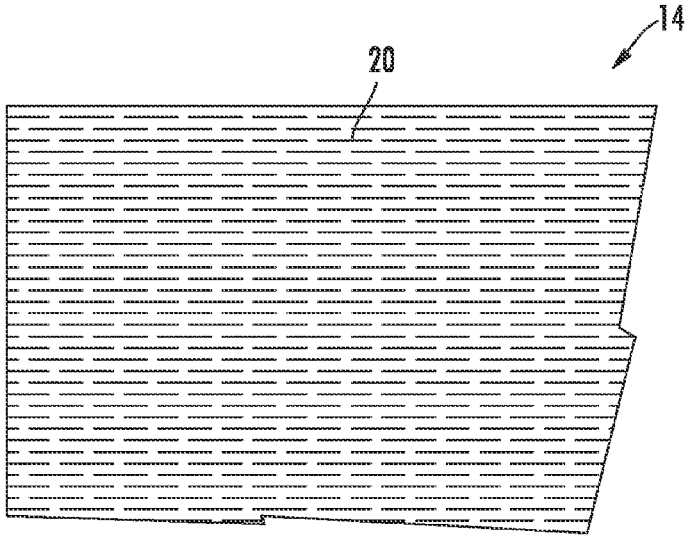
FIG. 3 is a front view of a portion of susceptor material for a package according to an exemplary embodiment.

Referring now to FIG. 3, according to an exemplary embodiment, susceptor 14 may be ventilated (e.g., perforated, slit, woven, including ventilation apertures or holes, etc.). Ventilating microwave susceptors to release fluids such as steam, water vapor, etc. generated as a result of the baking of bread, rolls and biscuits and similar products is intended to maximize the heat available for crust formation and browning, and reduce separation between the susceptors (e.g., susceptor 14) and the surface of food products (e.g., food product 12). Ventilation of susceptor 14 allows steam generated by the microwave baking process to pass from the surface of food product 12 by the shortest possible route to the atmosphere. This is intended to ensure that contact between food product 12 and susceptor 14 is maintained and there is minimal or no separation due to the build up of steam pressure at surface 18 (e.g., crust) of food product 12. Such separation is undesirable because it prevents heat conduction and creates an additional cooling effect due to the passage of steam between susceptor 14 and surface 18 of food product 12, which adversely effects the crispness and browning of the surface or crust.

Furthermore, where a ventilated susceptor such as susceptor 14 may be used to re-crisp or finish the crusting of pre-baked (or partially pre-baked products), ventilated susceptor 14 provides a more desirable result compared to known packaging solutions because the driven-off steam is ventilated to the atmosphere more quickly without being reabsorbed into the crust, and the crust therefore reaches a higher temperature.

Figure 4:
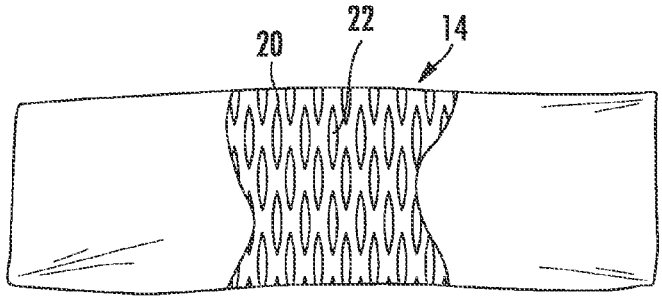
FIG. 4 is a front view of a portion of the susceptor material of FIG. 3 in a stretched orientation according to an exemplary embodiment.

Referring to FIGS. 3 and 4, according to an exemplary embodiment, susceptor 14 may be ventilated by providing a number of slits or perforations 20 (e.g., apertures, holes, etc.) in susceptor 14. As shown in FIGS. 3 and 4, the slit patterns of adjacent rows of slits 20 may be offset relative to one another in order to maintain the structural integrity of susceptor 14. According to an exemplary embodiment, slits 20 may be approximately 14.0 mm in length, and slits in the same row may be spaced approximately 3.0 mm apart, with adjacent rows being spaced apart at a distance of approximately 3.0 mm. According to various alternative embodiments, the slit pattern may take other configurations, shapes, and orientations, and the dimensions of the slit pattern may be varied to suit particular applications.

According to an exemplary embodiment, the slit pattern may be chosen in order to maintain the mechanical integrity of susceptor 14 and ensure proper crusting or browning of the surface of food product 12. If the slit pattern is too fine in pitch (e.g., such that the rows of slits 20 are too close), not only may susceptor 14 become inherently mechanically weak, leading to failure (e.g., tearing, etc.) of susceptor 14 when being removed from food product 12 after baking, but the heating efficiency of susceptor 14 may be adversely affected when the strip width between slits decreases as a result of failure (e.g., deterioration, etc.) of the metallic layer of the susceptor 14 (e.g., in the case of sputtered aluminum susceptor materials).

According to an exemplary embodiment, the slit pattern of slits 20 (as well as the material composition and thickness) may be chosen, adjusted, modified, etc. in order to ensure proper "drape" of susceptor 14 relative to food product 12. As used herein and further discussed below, drape may refer generally to the conformation of a susceptor (or at least a portion of the susceptor) to a food product, which may require the susceptor to take on a variety of shapes and/or configurations (e.g., to conform to curved bread products, oddly-shaped food products, etc.).

FIG. 3 shows an exemplary perforated pattern of susceptor 14, and although there are slits 20 through the susceptor material to allow ventilation, the whole area of susceptor 14 remains active (e.g., to brown or crisp food product), enabling even browning of the surface of food products and free flow of steam through susceptor 14 to the atmosphere (ventilation). For example, FIG. 4 shows perforated susceptor 14 of FIG. 3 slightly stretched so that the pattern of perforation and gaps 22 are more clearly illustrated.

According to an exemplary embodiment, the perforation or slitting of susceptor 14 may be accomplished by the use of a rotary die cutting technique, allowing high-volume manufacturing processes. According to various other exemplary embodiments, other methods of producing the slit pattern could be used.

Figure 2:
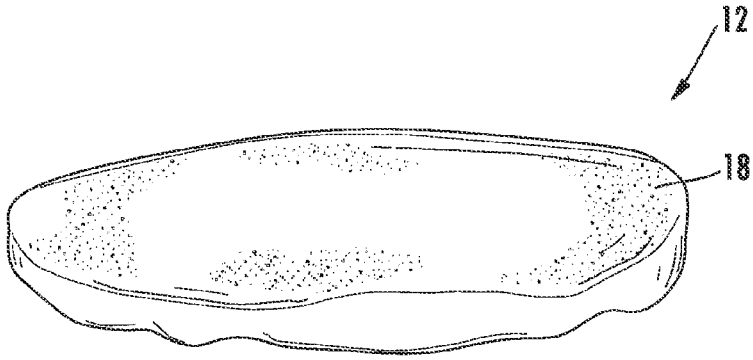
FIG. 2 is a perspective view of a food product having a crisped or browned portion according to an exemplary embodiment.

As shown in FIG. 2, effective ventilation results in even browning of surface 18 of food product 12. Unventilated susceptors often result in surfaces that do not brown readily and contain white patches that are visible as a result of steam pockets having inhibited (direct and concentrated) heating of the crust surface and generating a higher level of moisture in the crust.

Susceptor 14 includes a number of slits 20 configured to provide ventilation for susceptor 14. After having been used to bake a food product within a microwave, susceptor 14 may deform slightly (e.g., the slits allow portions of susceptor 14 to move out of the pre-baking, generally coplanar orientation). This slight deformation facilitates the release of steam from food product 12 (e.g., as a result of the enlargement or creation of gaps 22 between the adjacent portions of susceptor 14) while permitting susceptor 14 to maintain intimate contact with food product 12 sufficient to provide proper browning, etc. to the food product surface.

Figure 5:
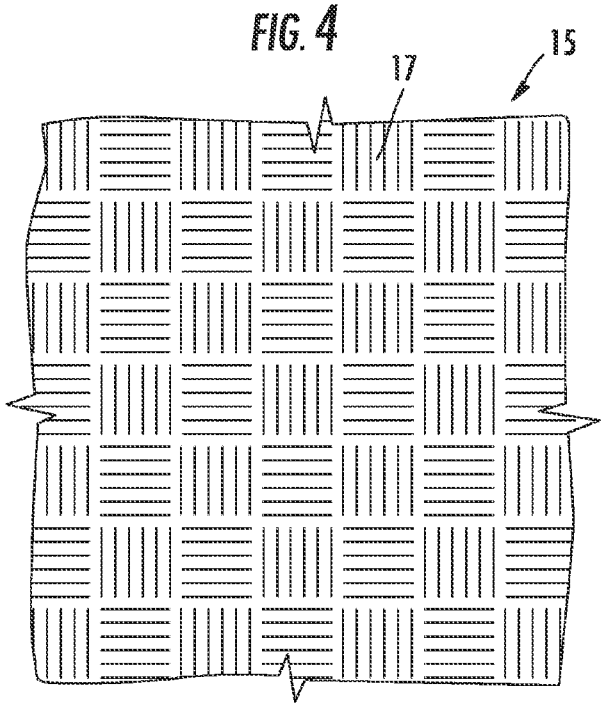
FIG. 5 is a schematic representation of a portion of susceptor material according to an exemplary embodiment.

Referring to FIG. 5, a portion of a susceptor 15 is shown according to an exemplary embodiment. Susceptor 15 may include a number of slotted areas 17 (e.g., generally square, rectangular, or other shaped areas or groups), each including one for more generally parallel apertures (e.g., slits, elongated holes, etc.). Areas 17 may be configured such that the slot patterns of adjacent areas are at approximately 90 degrees (or, alternatively 30 degrees, 45 degrees, etc.) orientation with respect to each other. As shown in FIG. 5, areas 17 may form a "parquet" pattern of ventilation slots for a susceptor. Such a parquet pattern may resist undesirable irregularities in the ventilation provided by susceptor 15 during use as compared with more conventional susceptors or other ventilated susceptor patterns.

Figure 10:
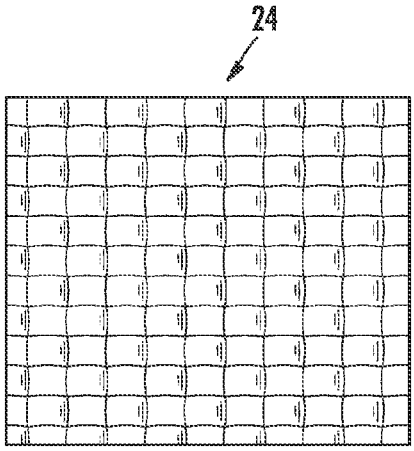
FIG. 10 is a front view of a portion of susceptor material according to an exemplary embodiment.
Figure 11:
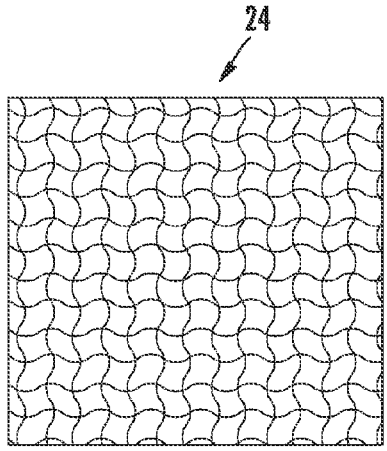
FIG. 11 is a front view of a portion of susceptor material according to an exemplary embodiment.

Referring now to FIGS. 10 and 11, according to an exemplary embodiment, a susceptor 24 may be provided in a woven form. Referring to FIG. 10, strands of susceptor material may be woven together in order to provide ventilated susceptor 24. Ventilation is provided through the spaces between the woven strands (e.g., at the intersections of the warp and weft). In order to increase the space between strands, and thereby increase the ventilation of susceptor 24, the susceptor strands may be provided with a wavy-edge pattern (see, e.g., FIG. 11) such that the space between strands increases relative to a straight-strand pattern. In some embodiments, susceptor 24 may be otherwise similar in construction to susceptor 14.

The weave pattern should be of the proper pitch, because if the weave pattern is too fine in pitch the heating efficiency of susceptor 24 can be adversely effected as the strip width between slits becomes too small, as this can result in result of failure of the metallic layer of susceptor 24 (e.g., in the case of sputtered aluminum susceptor materials).

Woven susceptor 24 may be produced using any appropriate weaving technique, including those used, for example, to produce bulk packages for agricultural feedstock, fertilizer, etc., and a variety of strand widths may be used to form the woven susceptor 24.

Referring further to FIGS. 10 and 11, it should be noted that woven susceptor 24 may in effect provide a two-layer susceptor. The woven pattern is generated by a first set of generally parallel strands (e.g., the warp strands) being interwoven with a second set of generally parallel strands (e.g., the weft strands). Because each set of strands in itself provides a single layer of susceptor material, the woven pattern results in a structure having two layers of susceptor material (e.g., one layer made of the warp strands, one layer made of the weft strands). As discussed in more detail below, providing a multi-layer susceptor may provide advantages over a single layer susceptor in terms of controlling the amount of microwave energy that is reflected, absorbed, and/or transmitted by the susceptor.

Generally, when a susceptor encounters microwave energy, a portion of the energy may be reflected, a portion of the energy may be absorbed, and a portion of the energy may be transmitted. Energy that is reflected by the susceptor may be reflected back into the cavity of the microwave oven. Energy that is absorbed by the susceptor may be converted into heat within the metallic layer (e.g., as a result of the eddy currents flowing within a thin sputtered metallic (e.g., aluminum) layer) and transferred to the surface of the food product and facilitate crisping and browning of the food product. Energy that is transmitted by the susceptor may pass to the body of the food product as microwave energy and serve to heat the food product.

According to an exemplary embodiment, two layers of susceptor material (e.g., having two metallic layers) may be used in order to provide the proper balance of the amount of microwave energy that is reflected, absorbed, and transmitted by the susceptor. The two susceptor layers may be configured such that they transmit less and absorb more energy than a single susceptor. This may reduce the production of moisture from the interior of the food product resulting from energy transmitted by the susceptor layer (and thereby reduce the generation of steam at the surface of the food product), and increase the crisping or browning effect of the susceptor. Furthermore, the two susceptor layers may help to prevent over-baking of the core of a food product during baking. The two susceptor layers may be coupled (e.g., heat sealed, heat staked, adhesively bonded, laminated, etc.) and made up of two layers of conventional susceptor material. Alternatively, a two-layer susceptor may be provided as a woven susceptor, as discussed with respect to FIGS. 10 and 11.

According to an exemplary embodiment, each susceptor layer of a two-layer susceptor may include a substrate material, a metallic layer coupled to the substrate, such as a sputtered or a vacuum metallized aluminum layer, and a paper layer (e.g., paper, paper board, a card layer, etc.) that is adhesively bonded to the substrate/metallic layer. The substrate provides support for the metallic layer. The metallic layer acts to transmit, reflect, and absorb microwave energy. The paper layer acts to promote dimensional stability, preventing distortion of the substrate caused by shrinkage of polymer films at elevated temperatures, and insulates the food product (contains heat). According to an alternative embodiment, a cellophane material may be used in place of the paper layer.

According to various other exemplary embodiments, the susceptor layers may be made of any suitable materials, including those illustrated with respect to the other embodiments described herein.

Figure 12:
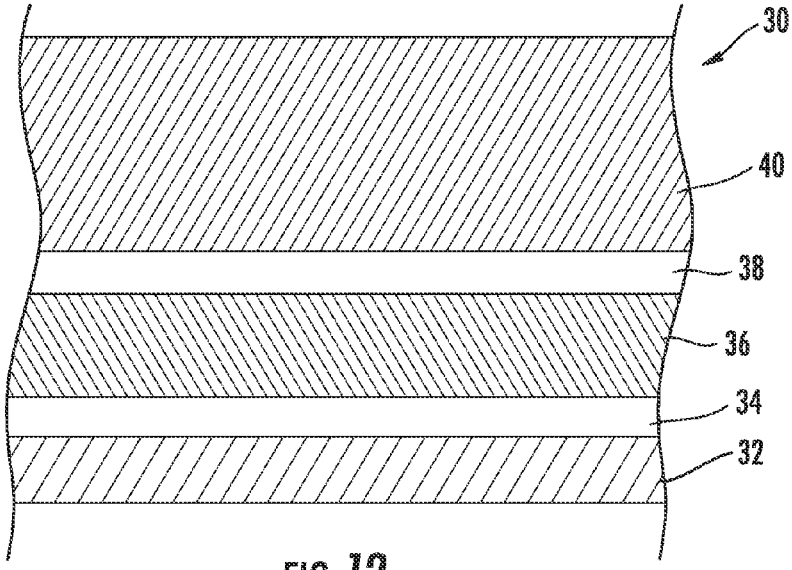
FIG. 12 is a cross-section view of susceptor material according to an exemplary embodiment.

Referring to FIG. 12, a two-layer susceptor 30 is shown according to an exemplary embodiment. As shown in FIG. 12, two-layer susceptor 30 may include an inner (e.g., facing the food product) polymer layer 32 (e.g., a PTFE layer), a first metallic (e.g., aluminum) layer 34, a substrate 36 (e.g., a high temperature polymer film made from PEEK), a second metallic (e.g., aluminum) layer 38, and an outer polymer layer 40 (e.g., a PET layer). Two-layer susceptor 30 shown in FIG. 12 may provide advantages over other types of two-layer susceptors that are formed from separate susceptor materials because two-layer susceptor 30 shown in FIG. 12 may eliminate much or all of any air that may otherwise be present between susceptor layers and act as an insulator, reducing the amount of energy that may be transferred to the food product.

According to an exemplary embodiment, two-layer susceptor 30 may be a flexible susceptor such that it may be conformed, draped, etc., over a food product. Furthermore, two-layer susceptor 30 may be provided with ventilation apertures provided in a slit configuration similar to that discussed with respect to, for example, FIGS. 3-5. Other means of providing ventilation may be used according to various other exemplary embodiments.

According to one embodiment, where a ventilated susceptor (e.g., susceptor 14 shown in FIGS. 3-4, etc.) is applied to pre-baked products, no additional support may be necessary. However, when susceptors are used with un-baked or partially baked food products, it may be necessary to provide a support member in order to properly support the susceptor during the baking process. The support member is intended to ensure the correct shape of the final product and to prevent rising dough from being extruded into the slits and becoming mechanically locked to the susceptor (e.g., as a result of the dough expanding during a proofing process).

Figure 6:
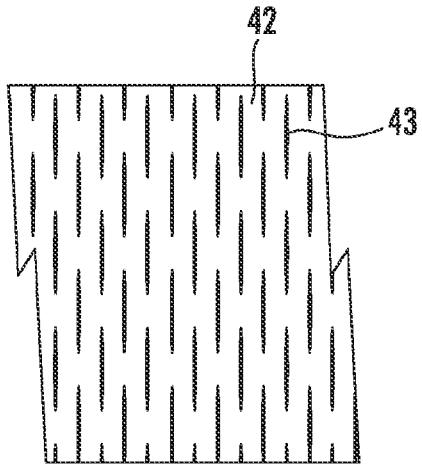
FIG. 6 is a front view of a support layer or member according to an exemplary embodiment.
Figure 9:
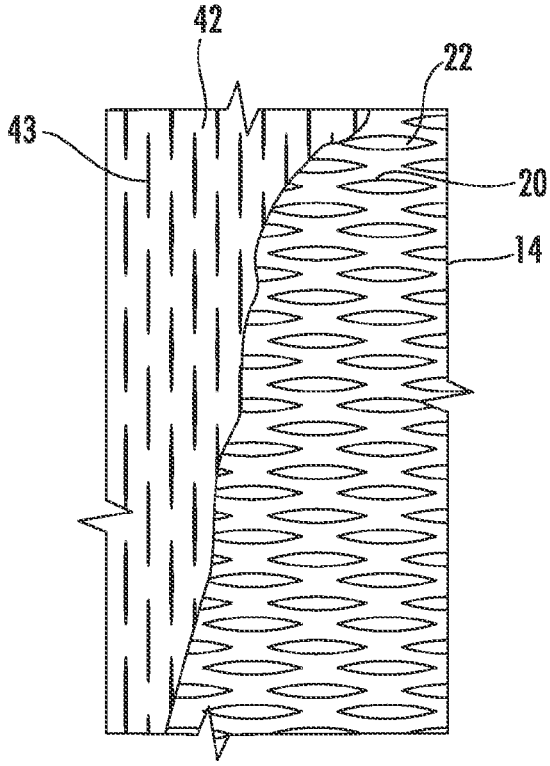
FIG. 9 is a front view of a susceptor material coupled to a support layer or member according to an exemplary embodiment.

Referring to FIGS. 6 and 9, according to one exemplary embodiment, a support member 42 may be provided as a solid board or card member, slit in a similar manner to susceptor 14. As shown in FIG. 9, support member 42 may be secured to susceptor 14 such that slits 43 in support member 42 are at a 90 degree orientation relative to slits 20 in susceptor 14. Orientating susceptor 14 and support member 42 in this fashion assists in maintaining the structural integrity of susceptor 14 and aids in preventing food product from extruding through slits 20 in susceptor 14 and/or support member 42.

Figure 7:
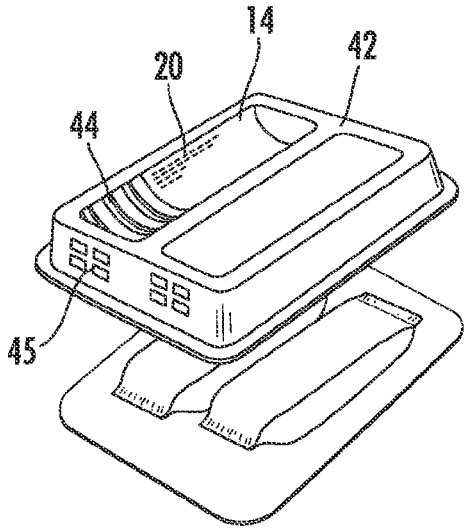
FIG. 7 is a perspective view of a susceptor material coupled to a support layer or member according to an exemplary embodiment.

Referring to FIG. 7, according to another exemplary embodiment, support member 42 may be a formed component (e.g., a thermoform, etc.) that has one or more slits, slots, etc. 44 that are orientated at 90 degrees from slits 20 in susceptor 14. Support member 42 may further include on or more apertures 45 (e.g. holes, slits, etc.) configured to permit steam and/or moisture to escape from the lower portion of support member 42.

Figure 8:
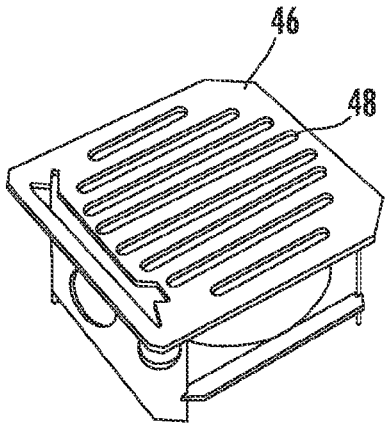
FIG. 8 is a perspective view of a support member according to an exemplary embodiment.

Referring to FIG. 8, according to another exemplary embodiment, a support member 46 may be or include a cardboard or corrugated card board member that includes one or more slits, slots, etc. 48 that are orientated at 90 degrees from the slits 20 in the susceptor 14 (not shown). It should be noted that for maximum strength slots 48 in support member 46 may be parallel to the board flutes of support member 46.

According to various other exemplary embodiments, one or more support members may take any of a variety of shapes, configurations, etc., and the slits in the susceptor may be orientated at other than a 90 degree angle (e.g., 45 degrees, etc.) relative to the slits, slots, etc. in the support member.

Figure 13:
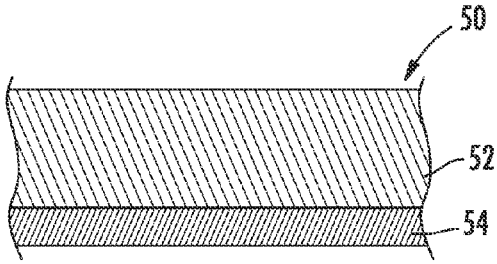
FIG. 13 is a cross-section view of susceptor material according to an exemplary embodiment.

Referring now to FIG. 13, a susceptor 50 is shown according to an exemplary embodiment and may provide a lower-cost alternative to more conventional susceptor structures. As shown in FIG. 13, susceptor 50 may include a substrate 52 (e.g., cardboard, etc.) upon which a conductive ink 54 (e.g., a conductive graphite ink, etc.) may be applied (e.g., by a printing process). According to an exemplary embodiment, substrate 52 may be made from a paper material (e.g., cardboard, etc.), which avoids the use of higher cost polymer substrate films or other substrate materials. In addition, by using a conductive ink that can be applied using conventional printing processes (e.g., flexographic or gravure printing, etc.), susceptor 50 may be produced efficiently at high volumes.

According to an exemplary embodiment, conductive ink 54 may be a conductive graphite ink. The presence of graphite within an ink "carrier" such as conductive ink 54 may provide a conductive ink having a higher resistivity than many metals such that the conductive ink may be applied in a coating of greater thickness (because the resistivity of the susceptor is generally inversely proportional to the thickness of metallic layer of the susceptor material) than many metals conventionally used, while achieving substantially the same results with respect to reflection, absorption, and transmission of microwave energy. Furthermore, graphite may be provided in a "food grade" such that it may be placed in direct contact with various food products while baking without the need for additional protective coatings, thereby further reducing costs.

According to an exemplary embodiment, susceptor 50 shown in FIG. 13 may eliminate the need for a separate metallic/polymer susceptor film material such that conductive ink 54 may be applied directly to a structural packaging material or other package for a food product.

While as shown in FIG. 13 substrate 52 may comprise a paper or cardboard material, according to various alternative embodiments, other materials may be used, including various types of polymer substrates, etc. Furthermore, while conductive ink 54 is shown to be a conductive graphite ink, conductive ink may 54 include other conductive materials or metallic materials according to various exemplary embodiments. The process used to apply conductive ink 54 to substrate 52, and the thicknesses of substrate 52 and/or conductive ink 54, may be varied to suit particular applications.

According to an exemplary embodiment, a food product such as food product 12 may be provided within a package in an uncooked state, such that the food product (e.g., a dough material for bread, biscuits, etc.) is "proofed" within the package. "Proofing" typically refers to the process of raw dough rising, or expanding, prior to baking. According to an exemplary embodiment, a food product such as dough may be inserted into a package prior to proofing. The package may include a susceptor material that may be formed to a desired final shape of the food product (e.g., the shape of a biscuit, a roll, etc.). The package material and the susceptor may create a cavity for receiving the raw dough. The raw dough may be introduced into the cavity, and prior to or during preparation of the final food product, the raw dough may be "proofed" within the package such that it expands to conform to the interior shape of the cavity, which may be any of a number of shapes, depending on the desired final shape of the food product. Proofing of the dough within the package may help to ensure intimate contact between the dough and the susceptor and permit the final food product to be provided in a variety of shapes or forms. According to an exemplary embodiment, a food product such as a raw dough may be partially proofed prior to being introduced into a package such that the remainder of the proofing may take place within the package.

According to an exemplary embodiment, a susceptor (e.g., susceptor 14) may be configured to drape around (e.g., conform to) the shape of a food product (e.g., food product 12). For example, a package may be provided with a separate susceptor inside the package. A food product may be introduced into the interior of the package that does not fill the entire interior space. If the susceptor and/or package were to be, for example, a rigid structure, there may be an opportunity for undesirable gaps or spaces to exist between the susceptor material and the food product should the susceptor material be provided so as to conform to the interior of the package.

According to an exemplary embodiment, a package may be provided that includes a susceptor material that is unsecured or only intermittently (partially) secured to the interior of the package, such that those areas that are not directly secured to the interior portion of the package may "drape" around, or conform to, the shape of the food product within the package. This may be advantageous in applications where the shape of the food product does not conform to the interior structure of the package, or in applications having oddly-shaped food products where providing a pre-formed package and/or susceptor material that conforms to the food product may be difficult and/or expensive.

According to one embodiment, the susceptor material may be intermittently heat-sealed to a package. According to various other exemplary embodiments, other methods of intermittently securing a susceptor material to a package may be used (e.g., ultrasonic welding, adhesives, mechanical fasteners, etc.).

Figure 14A:
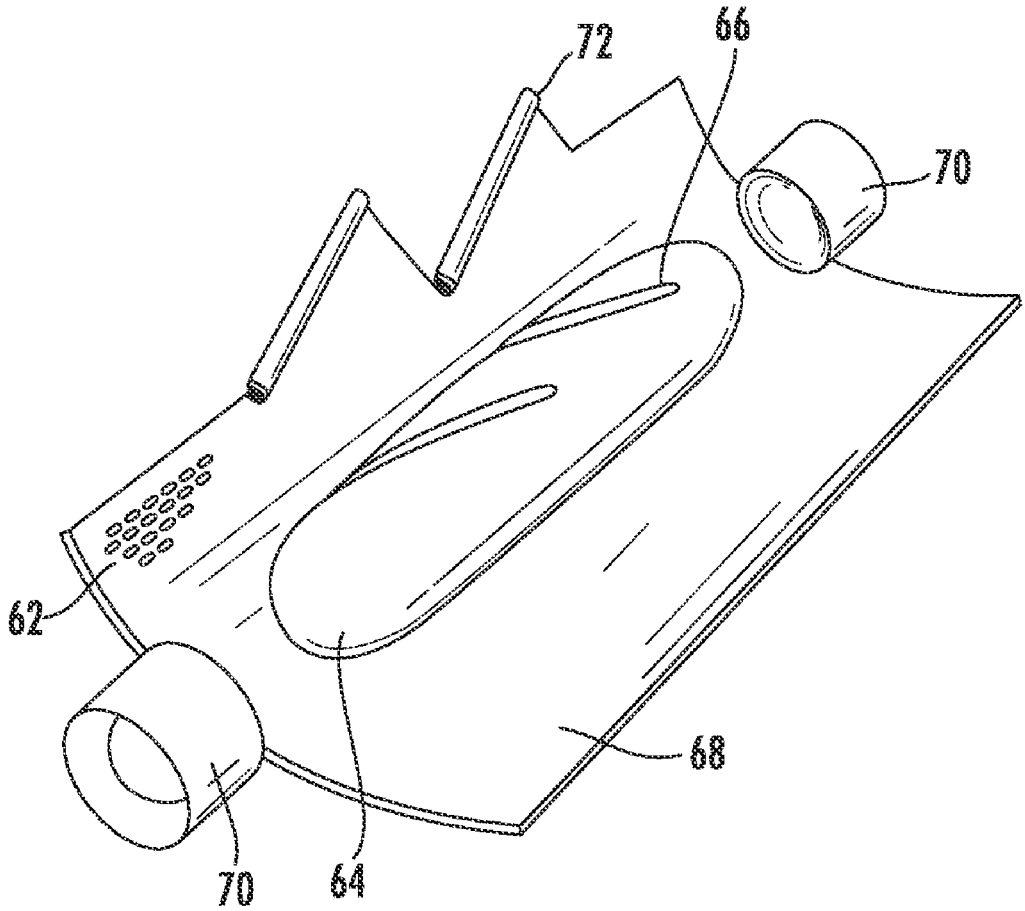
FIG. 14A is an exploded perspective view of a product including a package, a susceptor material, and a food product according to an exemplary embodiment.
Figure 14B:
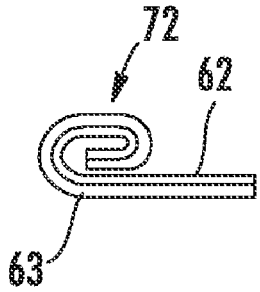
FIG. 14B is a cross-section view of a raised portion of a package according to an exemplary embodiment.

Referring now to FIGS. 14A and 14B, according to an exemplary embodiment, a package (not shown) and a susceptor 62 may be used to produce a food product 64 such as a bread, roll, biscuit, etc. in a microwave such that the finished food product 64 has one or more decorative elements 66 (e.g., simulated decorative knife cuts, etc.) in the surface (e.g., the browned or crisped surface).

Using a conventional oven, decorative knife cuts 66 or other decorative designs, etc. may be made into the surface of food product 64 (e.g., bread) using a knife or other utensil so that food product 64 contains a different surface texture from the remainder of the bread.

According to an exemplary embodiment, a package and susceptor 62 are configured to provide simulated knife cuts 66 in a bread, roll, biscuit, or product similar to food 64. Referring to FIG. 14A, susceptor 62 (shown attached to substrate 63 in FIG. 14B) may be provided within a package for browning or crisping food product 64 such as the roll shown in FIG. 14A. Susceptor 62 may include a main body portion 68 and two ends, or pistons 70. As shown in FIG. 14A, body portion 68 is in the unrolled state to illustrate the details of the susceptor 62. Body portion 68 may include one or more raised portions 72 (e.g., rolled portions, projections, etc.) that face food product 64 and are configured to leave an impression of raised portion 72 in the final baked food product 64. According to one embodiment, shown in FIG. 14A, raw dough may be introduced into body portion 68 (in the closed or rolled configuration) and two pistons 70 may be introduced into the ends of rolled body portion 68. The raw dough may be "proofed" within the package such that it substantially conforms to the interior of body portion 68. As the bread is proofed, the dough may conform to the shape of raised portions 72 on the interior surface of the body of susceptor 62. According to an exemplary embodiment, pistons 70 may slidably engage body portion 68 such that pistons 70 may slide outward during the proofing/baking process to accommodate changes in the shape and/or volume of the dough.

As shown in FIG. 14B, according to one embodiment raised portion 72 may be formed by rolling susceptor 62 (and substrate 63) upon itself to form a beaded portion and shield food product 64 from susceptor material 62. As a result, the portions of the surface of food product 64 adjacent raised portion 72 will receive less heat than the surrounding surface, and final food product 64 will have, once baked, a different surface texture (e.g., a less browned or crisped surface) for decorative knife cuts 66 relative to the surrounding surface area.

As shown in FIG. 14A, main body 68 of susceptor 62 may be made from a single integrated sheet or separate sheets of susceptor and substrate material. An edge of the sheet may include a "saw-tooth" configuration intended to simulate, for example, one or more knife cuts being made at approximately a 45 degree angle across the surface of the food product 64. According to various exemplary embodiments, other decorative features and/or elements may be formed into the surface of food product 64 by altering the configuration (e.g., shape, size, etc.) of raised portion 72. Furthermore, while pistons 70 shown in FIG. 14A may be moveable pistons having a ventilated susceptor material applied or coupled to a rigid, semi-circular support structure, other forms of pistons (e.g., without a susceptor material, non-slidable, in other shapes such as square, etc., and so on) may be used according to various other exemplary embodiments. In some embodiments, pistons 70 may be injection molded, thermoformed, or pulp-molded paper board, and may be provided with ventilation apertures.

Figure 15A:
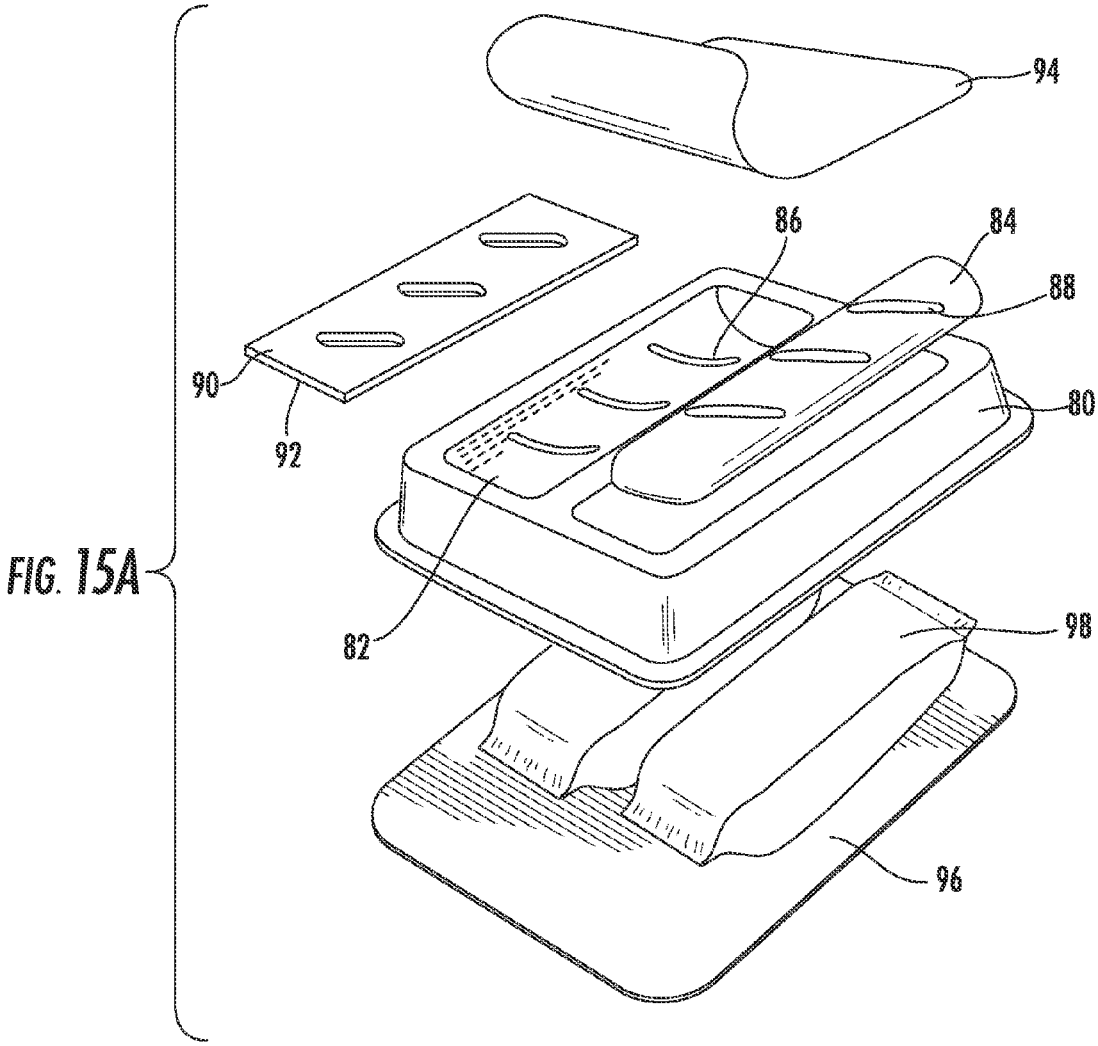
FIG. 15A is an exploded perspective view of a product including a package, a susceptor material, and a food product according to an exemplary embodiment.
Figure 15B:
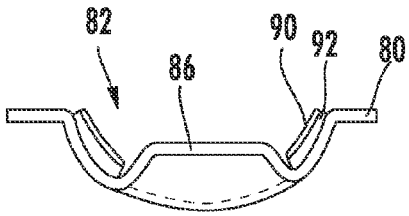
FIG. 15B is a cross-sectional view of a portion of the product of FIG. 15A according to an exemplary embodiment.

Referring to FIG. 15A, another exemplary method of forming simulated knife cuts or other decorative features on the surface of a baked food product is illustrated. A support member such as a tray 80 may be provided with one or more wells 82 designed to hold a food product 84 such as a sub roll, etc. Wells 82 may be provided with a number of formed (e.g., thermoformed) projections 86 intended to provide a decorative element or appearance such as a simulated knife cut 88 to food product 84. A susceptor 90 may line the interior of well 82 except for a portion of well 82 having projections 86. According to an exemplary embodiment, a paper or cardboard member 92 may be provided between susceptor 90 and tray 80 to prevent deformation of tray 80 during baking.

According to an exemplary embodiment, a filling material 98 (e.g., meat, cheese, etc.) may be provided, for example, below tray 80, and top and bottom supports or panels 94, 96 may seal food product 84 and filler material 98 in position adjacent to tray 80. An additional outer package may also be provided, as discussed in more detail below.

Referring further to FIG. 12, two-layer susceptor 30 is shown according to an exemplary embodiment. As shown in FIG. 12, two-layer susceptor 30 may include an inner (e.g., facing the food product) polymer layer 32 (e.g., a PTFE layer), a first metallic (e.g., aluminum) layer 34, a substrate 36 (e.g., a high temperature polymer film made from PEEK), a second metallic (e.g., aluminum) layer 38, and an outer polymer layer 40 (e.g., a PET layer). Two-layer susceptor 30 shown in FIG. 12 may provide advantages over other types of two layer susceptors that are formed from separate susceptor layers because two-layer susceptor 30 shown in FIG. 12 may eliminate much or all of any air that may otherwise be present between susceptor layers and act as an insulator, reducing the amount of energy that may be transferred to the food product. Furthermore, the polymer components of susceptor 30 may resist degradation due to acid that may be produced from certain food products such as dough, etc., thereby avoiding the disadvantages of many susceptor materials that include paper or cardboard components.

Referring again to FIG. 15A, according to an exemplary embodiment, a package and susceptor may be provided that create an exposed crumb structure to simulate cut surfaces when microwaving food products such as dough for bread, rolls, and similar items. As noted in this disclosure, susceptors may be used in a variety of applications to provide a browned or crisped surface for a food product such as bread, biscuits, rolls, etc. However, it may also be desirable to be able to provide a freshly-cut or sliced appearance to such products (e.g., in applications such as cut French sticks which have crumb structures exposed at the ends, a cut sub roll ready for filling with meat, cheese, etc., and so on).

According to the embodiment shown in FIG. 15A, thermoform tray 80 may be provided with perforated susceptors and two halves of a roll that may be, for example, a sub roll for later filling with a filling material. Top portion 94 may be provided as an aluminum sheet or shield having a thickness greater than a conventional susceptor provided on the surface of the roll portions that are intended to look freshly cut. Because of the relative thicker metallic layer of the aluminum, in some embodiments little or no local heat is transferred to the surface of food product 84 because the microwave energy is largely reflected. This results in a lighter, thinner, "skin" being formed over the surface of the food product 84 adjacent shield 94. Furthermore, because the thicker aluminum layer reflects more microwave energy than a conventional susceptor, it may be used to avoid over-baking of the food product.

Referring further to FIG. 15A, according to an exemplary embodiment, shield 94 (or other sheet in contact with the food product) may be intended to couple or bond to the surface of food product 84. Such adherence may be provided by a surface treatment on shield 94. For example, shield 94 may be positioned such that it is in intimate contact with the surface of food product 84 intended to have a sliced appearance (i.e., an exposed crumb surface). During baking, food product 84 may adhere to shield 94 due to the presence of the surface treatment on the surface of shield 94. After baking, when shield 94 is removed (e.g., peeled away), the light, thin, skin formed on the surface of food product 84 adheres to shield 94 and is peeled away from food product 84, leaving the underlying crumb structure exposed.

According to an exemplary embodiment, the surface treatment may include a polyvinyl acetate (PVA) adhesive film coating that becomes "tacky" at elevated temperatures (e.g., at temperatures typically generated during use of a microwave oven) and thereby forms a bond with the adjacent surface of food product 84 during baking. According to an alternative exemplary embodiment, the surface treatment may include a rough-textured surface intended to mechanically bond to food product 84 due to the rough nature of the surface of shield 94. According to one embodiment, the rough-textured surface may be provided by an abrasive paper that is coupled to shield 94. According to various other exemplary embodiments, other materials and/or methods may be used to provide a rough-textured surface to which food product 84 may bond.

Figure 16:
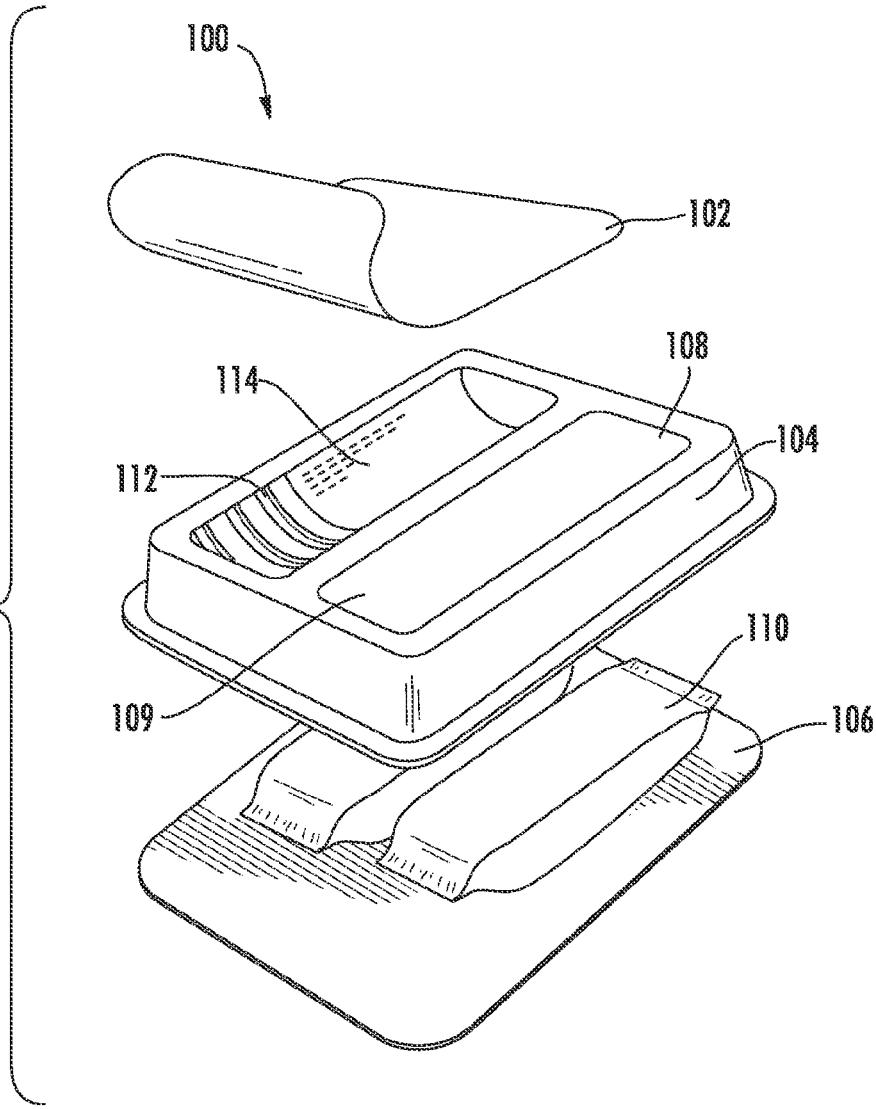
FIG. 16 is an exploded view of a product including a package, a susceptor material, and a food product according to an exemplary embodiment.

Referring now to FIG. 16, a product 100 is shown according to an exemplary embodiment and includes a top portion 102, a support portion 104, and a bottom portion 106. A first food product 108, such as a dough for bread rolls, etc., may be supported by the support portion 104, and a second food product 110, such as filler materials (e.g., meat, cheese, etc.) may be provided between support portion 104 and bottom portion 106.

According to an exemplary embodiment, top portion 102 may be an aluminum member (e.g., a lid, a foil, a board, etc.) that may be provided with a "peelable" heat seal (e.g., to seal the top portion to the support portion) for easy access to first food product 108. Support portion 104 may be a thermoformed polymer tray that includes one or more recessed portions, or wells, 109 that may conform to the outer shape of, for example, a sub roll. According to one embodiment, steam-release vents 112 may be provided in both wells 109 to facilitate the escape of steam from first food product 108 as it is heated. Susceptors 114 may be selectively provided within each well 109 to provide a desired browned and/or crisped appearance to the surface of first food product 108. According to an exemplary embodiment, susceptor 114 may be a perforated high-power susceptor that may be laminated to a card material and coupled (e.g., clipped, etc.) to the well. The card may act as an insulator between the susceptor and the thermoformed support portion, preventing distortion of the support portion during baking due to the high temperatures of the susceptor.

Referring further to FIG. 16, second food product 110 may be provided beneath support portion 104 (e.g., between support portion 104 and bottom portion 106), and may include a variety of food products including one or more filling materials such as meat, cheese, lettuce, etc. Bottom portion 106 may be peelably heat sealed to support portion 104 to secure second food product 110 in place.

According to an exemplary embodiment, one or both of the outer surfaces of top and bottom portions 102, 106 may include printed material, graphics, or other display material intended to provide information such as advertisement information, product/brand information, manufacturer/distributor information, etc. Other types of information may further be provided on the surfaces of top and bottom portions 102, 106.

It should be understood that the embodiment shown in FIG. 16 may be used in conjunction with one or more of the other exemplary embodiments discussed herein related to susceptor technology, packaging, and use. For example, susceptor 114 may be one or more of a ventilated (slit or woven) susceptor, a single-layer susceptor, or a two-layer-susceptor, and/or the susceptor may be provided as a printed conductive ink. The first and/or second food product may be provided as a raw or partially baked food product (e.g., raw dough, partially-baked dough, etc.). Furthermore, the packaging may take any suitable form and/or shape, and the food products may be made from a variety of materials and be intended for use in preparing a wide variety of baked goods such as breads, rolls, biscuits, etc.

Figure 17:
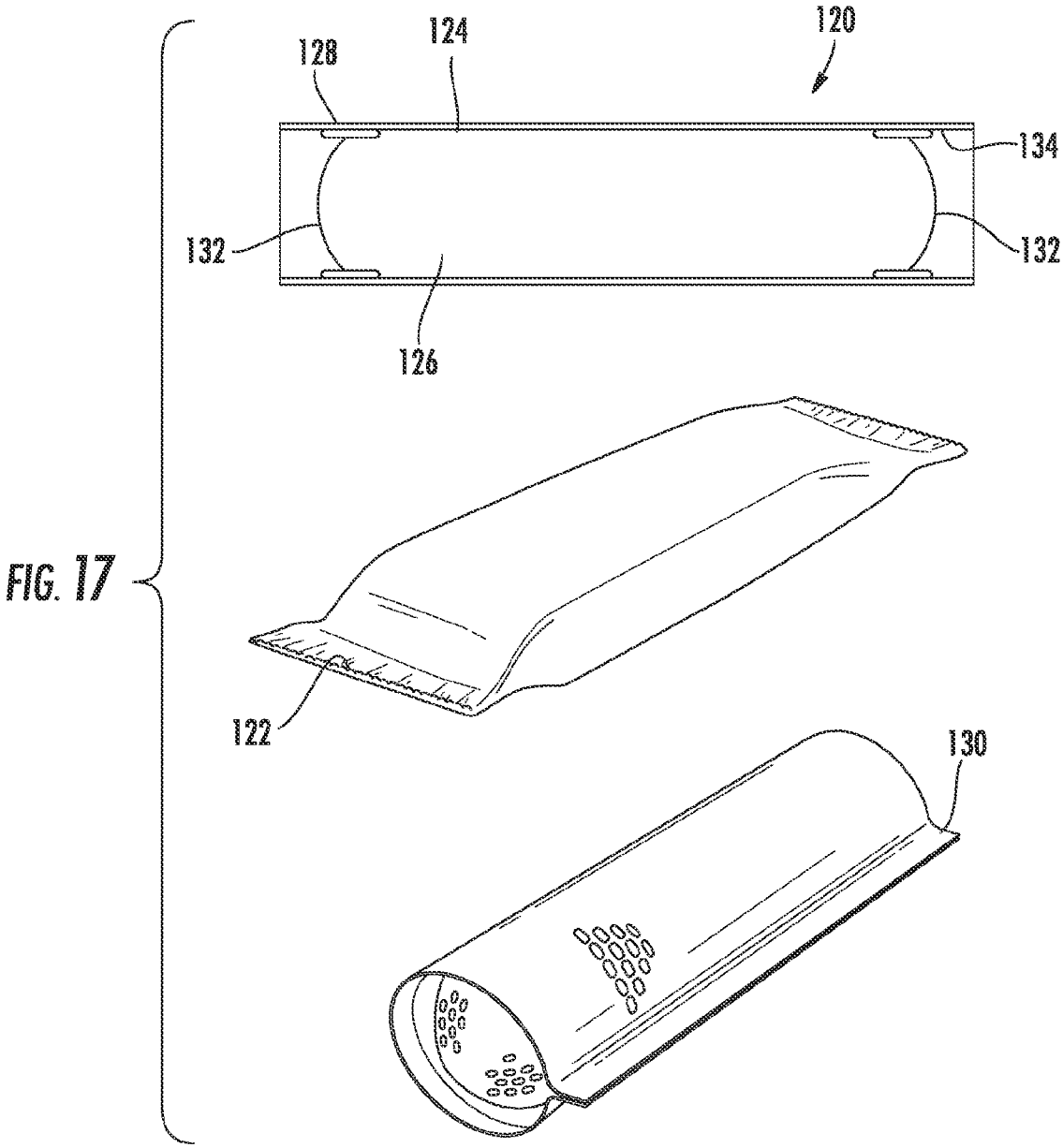
FIG. 17 is an exploded perspective view of a product including a package, a susceptor material, and a food product according to an exemplary embodiment.
Figure 18A:
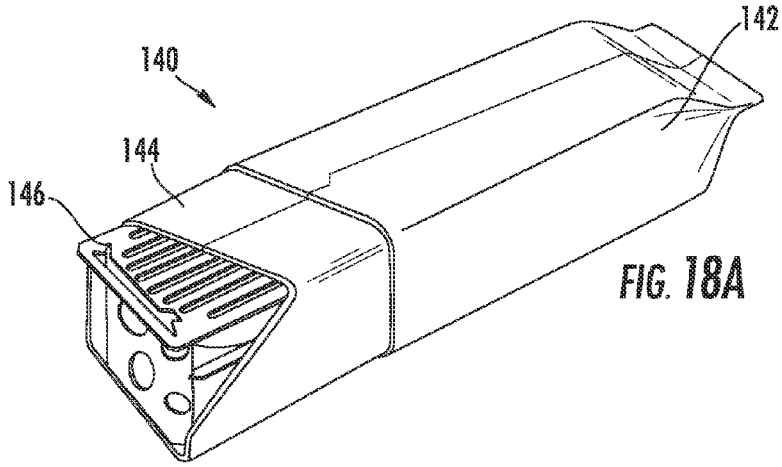
FIG. 18A is a cut-away perspective view of a product including a package, a susceptor material, and a food product according to an exemplary embodiment.
Figure 18B:
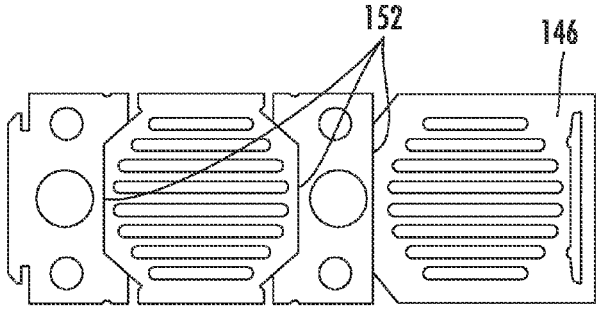
FIG. 18B is a front view of a support member according to an exemplary embodiment.
Figure 19:
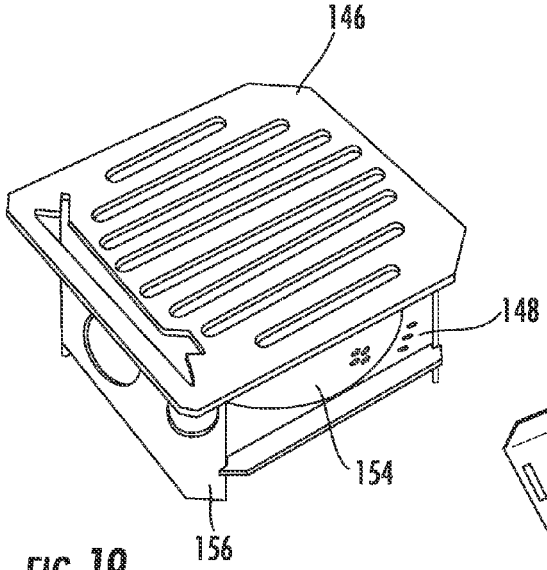
FIG. 19 is a perspective view of the support member of FIG. 18B according to an exemplary embodiment.
Figure 20:
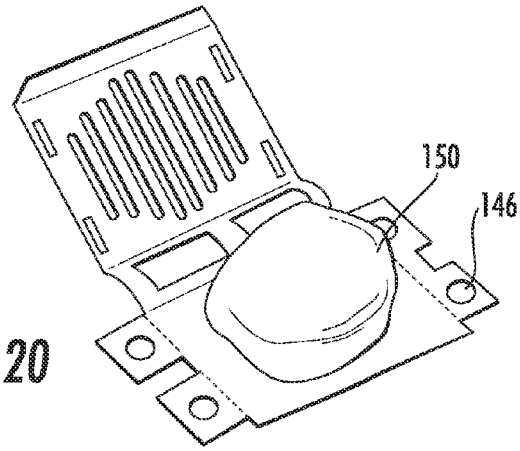
FIG. 20 is a perspective view of a support member and a food product according to an exemplary embodiment.

Referring to FIG. 17, a product 120 is shown according to an exemplary embodiment and may include a package 122, a susceptor 124, and a food product 126. According to an exemplary embodiment, susceptor 124 may be laminated or otherwise secured to a light tubular card for support. Susceptor 124 may be a high-power, perforated susceptor that may be formed as a tube 128 having a generally cylindrical shape, and may have a tear strip fin seal 130 intended to provide easy opening of tube 128. Two end portions or pistons 132 may be provided in the form of plastic injection molded components or pulp paper molded components that are coupled to high power perforated susceptors. According to an exemplary embodiment, end portions 132 may be configured to move axially, as required, to accommodate a larger volume of food product as food product 126 is proofed and/or baked. Portions 134 (e.g., piston skirts, etc.) of the tube 128 may interface with end portions or pistons 132 and may be provided with shielding so as to not over-bake the end portions of food product 126 (e.g., as a result of being exposed to both the tube portion and the end portions). According to an alternative exemplary embodiment, rather than utilizing a tube susceptor with opposing end portions, a circular, oval, or otherwise shaped susceptor may be used to suit a variety of specific applications.

According to an exemplary embodiment, package 122 may be gas-flushed and include a vapor barrier. Package 122 may be a flow wrap package and be sealed at 3 or 4 sides. Other types of packages may be used according to various alternative embodiments.

Product 120 illustrated with respect to FIG. 17 provides a variety of benefits, including desirable branding and shelf standout, a familiar sub roll shape that may have rounded, crusted, and/or browned ends, and a non-circular cross-section to provide a more convenient food product for consumption (e.g., an oval or flattened cross-section rather than a circular cross-section). Furthermore, product 120 may utilize conventional packaging for the package. Further yet, end portions 132 may permit expansion of food product 126 during baking, and the contact between piston skirt 134 and the tubular susceptor portion may prevent overheating such that as end portions 132 travel axially away from each other during baking, the end portion susceptors are still functional and can crisp and/or brown the end surfaces of food product 126.

It should be understood that the embodiment shown in FIG. 17 may be used in conjunction with one or more of the other exemplary embodiments discussed herein related to susceptor technology, packaging, and use. For example, the susceptor may be one or more of a ventilated (slit or woven) susceptor, a single-layer susceptor, or a two-layer-susceptor, and/or the susceptor may be provided as a printed conductive ink. The food product may be provided as a raw or partially baked food product (e.g., raw dough, partially-baked dough, etc.). Furthermore, the packaging may take any suitable form and/or shape, and the food product may be made from a variety of materials and be intended for use in preparing a wide variety of baked goods such as breads, rolls, biscuits, etc.

Referring to FIGS. 18A-20, a product 140 is shown according to an exemplary embodiment and includes an outer package 142, a sleeve member 144, a structural member or support 146, a susceptor 148, and a food product 150. Outer package 142 may be made of a flexible material (e.g., a paper, polymer, etc.) and may be gas-flushed after food product 150 is introduced into outer package 142. Sleeve member 144 may be a wrap-around solid board sleeve that is intended to provide protection to food product 150 during transportation, display, handling, etc. Outer package 142 and/or sleeve member 144 may be provided with a tear strip (e.g., a weakened portion, etc.) to enable users to quickly and easily remove sleeve member 144 after outer package 142 is opened.

According to an exemplary embodiment, structural member 146 may be formed into a pre-determined shape (e.g., the general shape of a bun, roll, biscuit, etc.) to define an interior space, and susceptor 148 may be coupled (e.g., heat sealed, etc.) or may be left loose relative to one or more interior surfaces of structural member 146. For example, susceptor 148 may be draped on the top surface of a biscuit that is proofed during baking such that as the biscuit rises, susceptor 148 rises with it and is not constrained by being coupled to structural member 146. According to one embodiment, structural member 146 may be made from a stiff paper material (e.g., a board material, card material, etc.) and provided with one or more apertures, slots, holes, etc. 158 intended to provide proper ventilation for food product 150 during preparation. Structural member 146 may have three generally parallel seam areas 152 where structural member 146 may be folded in order to form a top portion, a bottom portion, and two side portions that surround food product 150. Susceptor 148 may be coupled to one or more of the top, bottom, and side portions to provide browning, crisping, etc. as desired. According to an exemplary embodiment, a support member or ring 154 may be provided in order to control and direct the radial expansion of the food product 150 (e.g., in the case of a circular or round food product such as a biscuit, roll, etc.). Ring 154 may also be omitted, such that food product 150 may expand radially due to the vertical constraints imposed by structural member 146. According to an exemplary embodiment, one side of ring 154 may be coupled to a susceptor material so that ring 154 may be positioned with the susceptor either facing toward or away from food product 150, permitting selective browning, crisping, etc. of the food product 150.

According to one embodiment, structural member 146 may be shaped such that once folded into a predetermined shape or configuration, portions of structural member 146 may act as clips, or locking members, that engage correspondingly shaped and positioned apertures, slots, etc. and assist in holding structural member 146 in position during preparation of food product 150. One or more portions of structural member 146 may further act as a spacer 156 (e.g., a projection, leg, etc.) that maintains a space between the main body of structural member 146 and, for example, a preparation surface, during microwaving, etc. This ensures proper venting of food product 150 and avoids formation of a "soggy" portion that may otherwise develop on the surface of the food product upon which the food product rests during preparation.

According to one embodiment, structural member 146 may be configured to generally conform to the shape of food product 150. According to various exemplary embodiments, more than one food product (e.g., more than one roll, biscuit, bun, etc.) may be fit within structural member 146. Furthermore, food product 150 may be "proofed" within structural member 146 so as to further conform to the interior shape or configuration of structural member 146.

Susceptor material 148 may be any of a variety of susceptor materials, including any of those discussed with respect to the other exemplary embodiments disclosed herein. According to an exemplary embodiment, susceptor material 148 may include two generally circular portions that may be coupled to (e.g., heat sealed, adhered, etc.) or loosely placed over the inside surfaces of the top and bottom portions of structural member 146, thus providing a crisped or browned appearance or texture to the top/bottom portions of food product 150 such as a roll, bun, biscuit, etc. Susceptor material 148 may further include one or more side portions intended to brown or crisp the side portions of food product 150. According to an exemplary embodiment, susceptor material 148 is only intermittently coupled to structural member 146 such that susceptor material 148 may properly "drape" over food product 150 during preparation.

The embodiments illustrated in FIG. 18A-20 provide many benefits over traditional susceptor packaging methods, including providing good shelf-standout for the product, creating a familiar browned and crispy shape of a biscuit, bun roll, etc., and being easy to use by consumers. Furthermore, the components shown in FIG. 18A-20 may permit easy incorporation of other components, such as an aluminum shield, etc.

It should be understood that the embodiments shown in FIGS. 18A-20 may be used in conjunction with one or more of the other exemplary embodiments discussed herein related to susceptor technology, packaging, and use. For example, the susceptor may be one or more of a ventilated (slit or woven)

susceptor, a single-layer susceptor, or a two-layer-susceptor, and/or the susceptor may be provided as a printed conductive ink. The food product may be provided as a raw or partially baked food product (e.g., raw dough, partially-baked dough, etc.). Furthermore, the packaging may take any suitable form and/or shape, and the food product may be made from a variety of materials and be intended for use in preparing a wide variety of baked goods such as breads, rolls, biscuits, etc.

Figure 21:
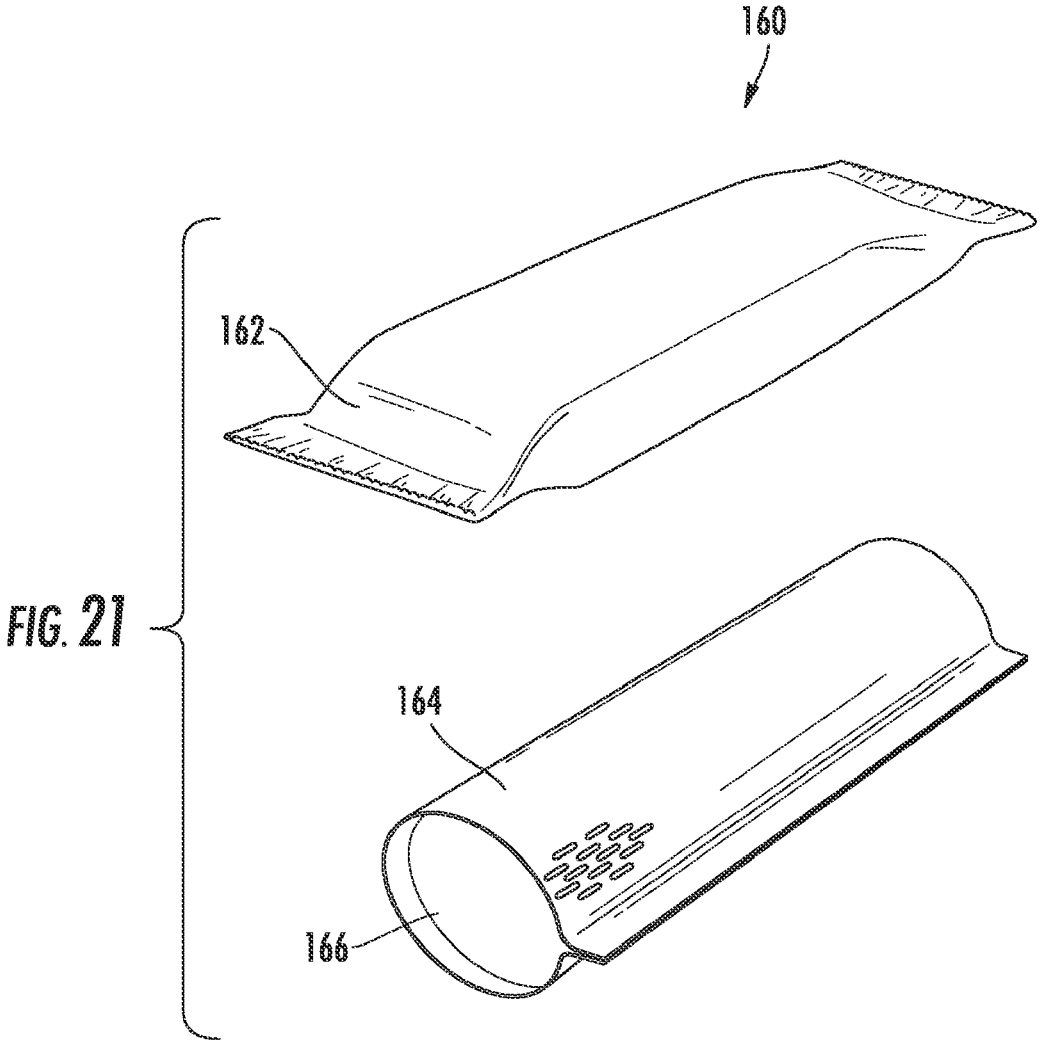
FIG. 21 is an exploded perspective view of a product including a package and a susceptor material according to an exemplary embodiment.

Referring to FIG. 21, a product 160 is shown as a sleeve pack or sleeve warmer according to an exemplary embodiment, and may include a package 162, a susceptor sleeve 164, and a food product 166. Package 162 may be a generally elongated, flexible package made from a suitable paper or polymer material and may include an easy-open feature such as a tear strip, etc.

Susceptor sleeve 164 may be a generally tubular member comprising a relatively stiff structural member in the shape of a tube and one or more portions of susceptor material. According to one embodiment, two pieces of susceptor material may be coupled to the structural tube portion in locations generally corresponding to the top and bottom surfaces of the food product, which may be a generally elongated bun, roll, etc. According to various exemplary embodiments, a single portion, or more than two portions, of susceptor material may be used.

Food product 166 may be a bread product that may be partially baked prior to packaging. According to various exemplary embodiments, food product 166 may be raw or fully baked prior to packaging. Susceptor material 164 may be chosen to provide an appropriate amount of browning and/or crisping to the surface of food product 166.

The embodiment illustrated in FIG. 21 may provide many benefits over traditional susceptor packaging methods, including providing good shelf-standout for the product, creating a familiar browned and crispy shape of a biscuit, bun roll, etc., and being easy to use by consumers. Furthermore, a paste such as a rice cone paste may be applied to at least a portion of the surface of food product 166 in order to improve the crispness of the surface of food product 166, in particular for food products with higher moisture levels.

It should be understood that the embodiment shown in FIG. 21 may be used in conjunction with one or more of the other exemplary embodiments discussed herein related to susceptor technology, packaging, and use. For example, the susceptor may be one or more of a ventilated (slit or woven) susceptor, a single-layer susceptor, or a two-layer-susceptor, and/or the susceptor may be provided as a printed conductive ink. The food product may be provided as a raw or partially baked food product (e.g., raw dough, partially-baked dough, etc.). Furthermore, the packaging may take any suitable form and/or shape, and the food product may be made from a variety of materials and be intended for use in preparing a wide variety of baked goods such as breads, rolls, biscuits, etc.

Figure 22:
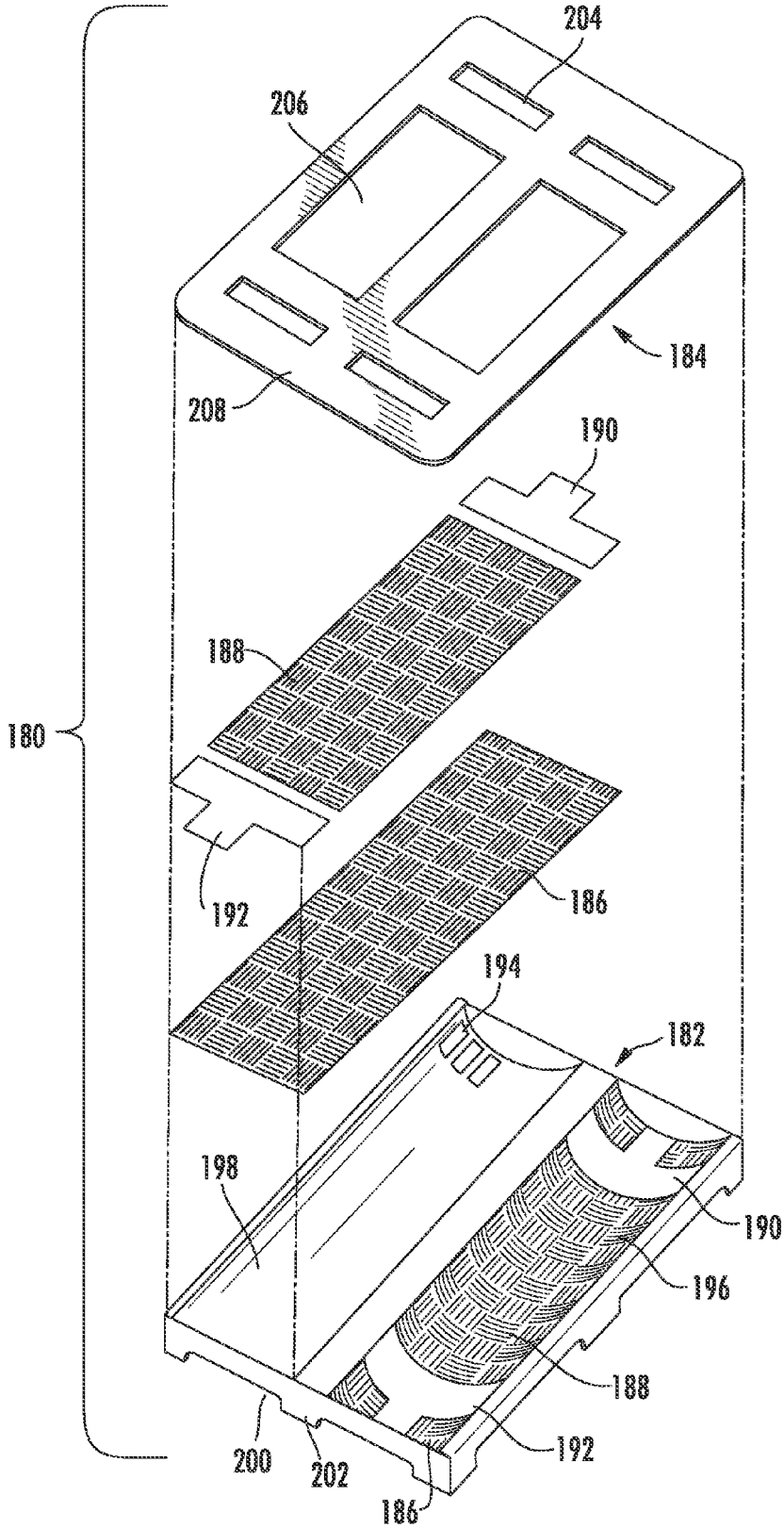
FIG. 22 is an exploded perspective view of a product including a package and a susceptor material according to an exemplary embodiment.

Referring to FIG. 22, a product 180 is shown according to an exemplary embodiment. Product 180 includes a support member 182 (e.g., a first portion, bottom portion, a formed portion, etc.), a first susceptor layer 186, a second susceptor layer 188, and a cover member 184 (e.g., a top layer, a lid, a cover, etc.). As shown in FIG. 22, support member 182 may include a pair of wells 198 that each receive first and second susceptors 186, 188. Wells 198 may include one or more ventilation apertures 194, which may be spread over the area of each well or selectively positioned to control the heating and/or ventilation of a food product (not shown). Wells 198 may be configured to receive first and second susceptor layers 186, 188, which may take a variety of shapes and sizes in various exemplary embodiments. For example, according to an exemplary embodiment, susceptor layers 186, 188 may include a parquet-style ventilation pattern as discussed herein. Furthermore, susceptor layer 188 may include portions 190 and 192 which may be formed from a different material (e.g., an aluminum shielding material) intended to provide more or less heat to a food product. Alternatively, portions 190, 192 may be integrally formed as part of susceptor layer 188. Support member 182 may further include ventilation apertures 200 which may be formed by supports or "feet" 202 and may permit steam and moisture to escape from the bottom of support member 182 during baking.

Referring further to FIG. 22, cover member 184 may include one or more apertures 204, 206, which may be intended to facilitate ventilation of a food product and/or control the browning of a surface of a food product (e.g., by letting more or less heat reach a food product). Cover member 184 may in some embodiments comprise an aluminum material over some or all of the area of member 184 to provide shielding of selected portions of a food product, or alternatively, provide a "fresh-cut" appearance to a food product by permitting a top layer of the food product to be peeled away after baking to expose the underlying crumb structure. In some embodiments, member 184 may include a lid of cover that snaps on to support member 182 to prevent lifting of member 184 during proofing and/or baking of a food product.

It should be understood that the embodiment shown in FIG. 22 may be used in conjunction with one or more of the other exemplary embodiments discussed herein related to susceptor technology, packaging, and use. For example, the susceptor may be one or more of a ventilated (slit or woven) susceptor, a single-layer susceptor, or a two-layer-susceptor, and/or the susceptor may be provided as a printed conductive ink. The food product may be provided as a raw or partially baked food product (e.g., raw dough, partially-baked dough, etc.). Furthermore, the packaging may take any suitable form and/or shape, and the food product may be made from a variety of materials and be intended for use in preparing a wide variety of baked goods such as breads, rolls, biscuits, etc.

Figure 23:
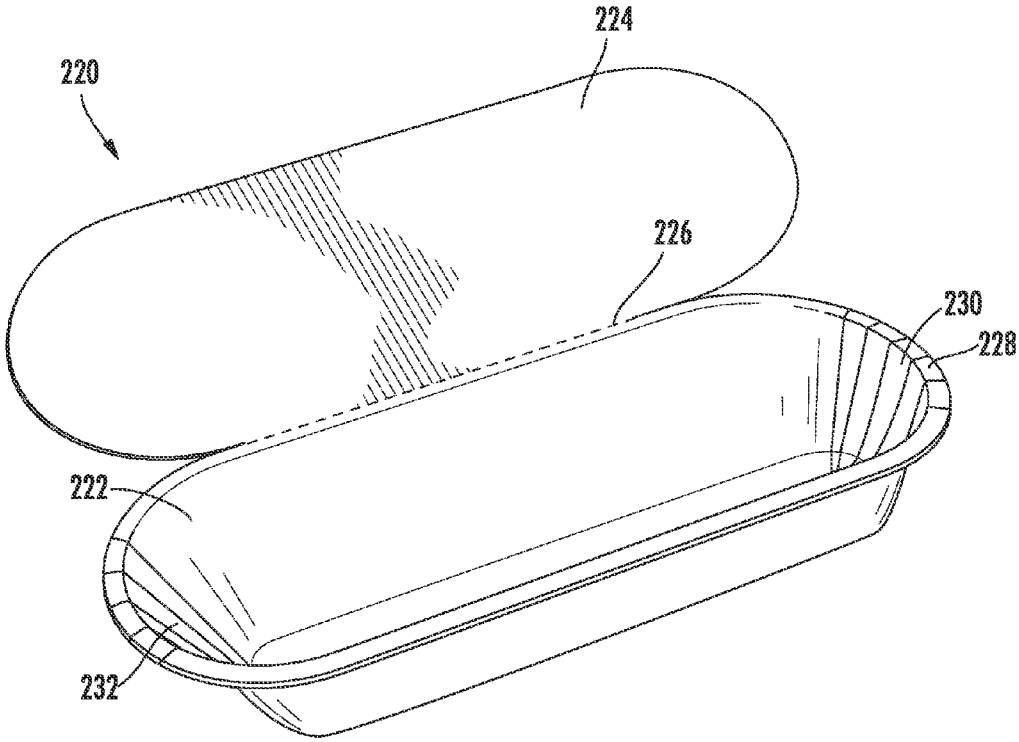
FIG. 23 is a perspective view of a product according to an exemplary embodiment.

Referring to FIG. 23, a product 220 is shown according to an exemplary embodiment. Product 220 may provide a lower-cost alternative to other products. Product 220 may include a support portion 222 that is coupled to a cover or top portion 224 via a hinge portion 226. Support portion 222 may take a general "bath tub" shape defined by two ends 230, 232 and be configured to hold a food product (not shown). A flange 228 (e.g., a sealing portion, lip, extending portion, etc.) may provide a sealing surface where cover member 224 may releasably seal with support member 222. A susceptor material may be provided over a portion or all of either one or both of support member 222 and cover member 224.

According to an exemplary embodiment, product 220 may be formed from a single sheet of material, such as cardboard, a card stock material, a laminate material, etc., which may further include a susceptor layer. Providing an integrally formed product may reduce material and labor costs associated with producing product 220.

It should be understood that the embodiment shown in FIG. 22 may be used in conjunction with one or more of the other exemplary embodiments discussed herein related to susceptor technology, packaging, and use. For example, the susceptor may be one or more of a ventilated (slit or woven) susceptor, a single-layer susceptor, or a two-layer-susceptor, and/or the susceptor may be provided as a printed conductive ink. The food product may be provided as a raw or partially baked food product (e.g., raw dough, partially-baked dough, etc.).

Furthermore, the packaging may take any suitable form and/or shape, and the food product may be made from a variety of materials and be intended for use in preparing a wide variety of baked goods such as breads, rolls, biscuits, etc.

It is important to note that the terms "package," "susceptor," and "food product" are intended to be broad terms and not terms of limitation. These terms may be used with any of a variety of products or arrangements and are not intended to be limited to use with particular applications.

Food product may be directed to dough-based "baked" or "bakery" goods, including yeast and/or chemical leavened products (e.g., bread, rolls, buns, bagels, pizza crust, biscuits, croissants, sweet goods, etc.), and unleavened products (e.g., pie crust, flat bread, foccaccia, etc.) where it is desirable to have at least a partially browned exterior or crust. The dough for the food products may be provided as raw dough, partially baked, or fully baked (ambient, refrigerated, or frozen). In some embodiments, the microwaves and susceptor are intended to provide heat to the food product for "baking" providing baked characteristics (i.e., the physical and chemical charges associated with baking in a conventional oven) as well as reheating, refreshening, or rethermalizing of dough based goods.

For purposes of this disclosure, the term "coupled" shall mean the joining of two members directly or indirectly to one another. Such joining may be stationary in nature or movable in nature. Such joining may be achieved with the two members or the two members and any additional intermediate members being integrally formed as a single unitary body with one another or with the two members or the two members and any additional intermediate member being attached to one another. Such joining may be permanent in nature or alternatively may be removable or releasable in nature. Such joining may also relate to a mechanical, fluid, or electrical relationship between the two components.

It is also important to note that the construction and arrangement of the elements of the package, susceptor, food product, and other components shown in the exemplary embodiments are illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, materials, colors, orientations, etc.) without materially departing from the novel teachings and advantages of the subject matter recited in the claims. Accordingly, all such modifications are intended to be included within the scope of the present disclosure as defined in the appended claims. The order or sequence of any process or method steps may be varied or re-sequenced according to alternative embodiments. Other substitutions, modifications, changes and/or omissions may be made in the design, operating conditions and arrangement of the exemplary embodiments without departing from the spirit of the present disclosure.

What is claimed is:

1. A susceptor comprising:

a flexible substrate; and a metallic material provided on at least one surface of the substrate;

wherein a first plurality of ventilation apertures are formed in the substrate and the metallic material, and the first plurality of ventilation apertures are configured to permit a fluid to pass through the substrate and the metallic material;

wherein the first plurality of ventilation apertures are provided in substantially rectangular-shaped groups of generally parallel slits, the orientation of the parallel slits varying by about 90 degrees between adjacent groups of parallel slits.

2. The susceptor of claim 1 wherein the substrate defines an interior portion, and the ventilation apertures are configured to permit steam to escape from the interior portion.

3. The susceptor of claim 1 wherein the ventilation apertures comprise a plurality of substantially parallel slits.

4. A susceptor comprising:

a flexible substrate; and a metallic material provided on at least one surface of the substrate;

wherein a first plurality of ventilation apertures are formed in the substrate and the metallic material, and the first plurality of ventilation apertures are configured to permit a fluid to pass through the substrate and the metallic material; and a support layer coupled to the substrate, the support layer comprising a second plurality of substantially parallel apertures oriented at approximately 90 degrees relative to the first plurality of ventilation apertures.

5. The susceptor of claim 1 wherein the metallic material comprises a conductive ink.

6. The susceptor of claim 4 wherein the conductive ink comprises graphite.

7. The susceptor of claim 1 wherein the metallic material is provided on a first surface and a second surface of the substrate.

8. The susceptor of claim 1 wherein the substrate comprises a thermoplastic material.

9. The susceptor of claim 7 wherein the thermoplastic material is one of polyethylene terephthalate (PET), polyetheretherketones (PEEK), and polytetrafluoroethylene (PTFE).

10. The susceptor of claim 7 further comprising:

a second metallic material provided on a surface of the thermoplastic substrate opposite the first metallic material;

a polymer outer layer coupled to the first metallic material opposite the substrate, and a polymer inner layer coupled to the second metallic material opposite the substrate;

wherein the first metallic material, the second metallic material, the outer layer, and the inner layer provide an integrated, double-layer susceptor.

* * * * *